United States Patent [19]

Scheithauer et al.

[11] Patent Number: 4,690,710

[45] Date of Patent: Sep. 1, 1987

[54] PROCESS FOR PRODUCING COBALT METAL POWDER

[75] Inventors: Richard A. Scheithauer; Clarence D. Vanderpool; Michael J. Miller; Richard G. W. Gingerich, all of Towanda, Pa.

[73] Assignee: GTE Products Corporation, Stamford, Conn.

[21] Appl. No.: 793,079

[22] Filed: Oct. 31, 1985

[51] Int. Cl.[4] ..... C22C 1/04

[52] U.S. Cl. ..... 75/0.5 AA; 75/108; 75/119; 423/143

[58] Field of Search ..... 75/0.5 AA, 108, 119; 423/143

[56] References Cited

U.S. PATENT DOCUMENTS

| | | | |
|---|---|---|---|
| 3,933,976 | 1/1976 | Nikolic et al. | 423/144 |
| 4,184,868 | 1/1980 | Ritsko et al. | 75/0.5 AA |
| 4,214,894 | 7/1980 | Ritsko et al. | 75/0.5 AA |
| 4,214,895 | 7/1980 | Gingerich et al. | 75/0.5 AA |
| 4,214,896 | 7/1980 | Cheresnowsky | 75/0.5 AA |
| 4,218,240 | 8/1980 | Gingerich et al. | 75/0.5 AA |
| 4,233,063 | 11/1980 | Ritsko et al. | 75/0.5 AA |
| 4,278,463 | 7/1981 | Vanderpool | 75/119 |
| 4,329,169 | 5/1982 | Gingerich et al. | 75/119 |
| 4,348,224 | 9/1982 | Gingerich et al. | 75/119 |
| 4,381,937 | 5/1983 | Gingerich et al. | 75/0.5 AA |
| 4,395,278 | 7/1983 | Vanderpool et al. | 75/0.5 AA |
| 4,409,019 | 10/1983 | Vanderpool et al. | 75/0.5 AA |
| 4,452,633 | 6/1984 | Miller et al. | 423/32 |
| 4,469,505 | 9/1984 | Cheresnowsky et al. | 75/0.5 AA |
| 4,594,230 | 6/1986 | Scheithauer et al. | 75/108 |

FOREIGN PATENT DOCUMENTS

| | | | |
|---|---|---|---|
| 1008196 | 10/1965 | United Kingdom | 75/119 |

*Primary Examiner*—John P. Sheehan

*Attorney, Agent, or Firm*—Donald R. Castle; L. Rita Quatrini

[57] ABSTRACT

A process is disclosed for producing pure cobalt metal powder. The process involves contacting a cobaltous salt with a sufficient amount of an alkaline earth halide in an aqueous solution at a sufficient temperature for a sufficient time to form a solution which is essentially cobaltous halide and a solid which consists essentially of a salt of the alkaline earth and the anion of the cobaltous salt. The cobaltous halide solution is removed from the solid and the ions in the solution are complexed with ammonia in the presence of a catalyst to form a cobaltic hexammine ion. The resulting solution is treated with an acid in the presence of halide ions to form a cobaltic hexammine halide precipitate which is removed from the resulting mother liquor and dissolved in an aqueous solution to form a relatively pure solution which is treated with a sufficient amount of a metallic hydroxide to form a cobalt containing precipitate which is reduced to cobalt metal.

7 Claims, No Drawings

PROCESS FOR PRODUCING COBALT METAL POWDER

BACKGROUND OF THE INVENTION

Cobalt metal has been produced by reduction of cobaltous oxalate. Cobaltous oxalate is generally produced by precipitating a solution of cobaltous chloride with oxalic acid or ammonium oxalate. By means of filtration, the cobaltous oxalate is separated from the liquor and washed in water. After drying, the cobaltous oxalate is pyrolysed in a reducing atmosphere at about 500° C. to produce the cobalt metal powder. Impurities in the metal powder are due to the impurities in the cobaltous oxalate which come from the cobaltous chloride solution. Washing the cobaltous oxalate by standard techniques such as with water or dilute acids and bases prior to pyrolysis does not reduce the impurities in the cobaltous oxalate and the impurities are therefore carried over to the cobalt metal. Such impurities render the metal powder unuseful for some applications such as in the hard carbide industry, and therefore the value of the cobalt is lowered.

A process for purifying cobaltous oxalate or other cobalt salt prior to conversion to cobalt metal would therefore be desirable.

The following U.S. Patents relate to cobalt processing: U.S. Pat. No. 4,184,868 relates to a method for producing extra fine cobalt metal powder by digesting cobalt pentammine chloride in ammonium hydroxide to obtain a black precipitate which contains cobalt and which is thereafter reduced to the metal powder. U.S. Pat. Nos. 4,214,894, 4,233,063, and 4,278,463 relate to improvements in 4,184,868 in which the ammonia solutions are processed to recover any cobalt therein. U.S. Pat. Nos. 4,395,278 and 4,469,505 relate to improvements in 4,184,868 in which fine cobalt metal powder is produced having reduced tailings.

U.S. Pat. No. 4,214,895 relates to a process for producing cobalt metal powder which involves treating an aqueous solution of a soluble cobaltic ammine halide with a sufficient amount of a soluble metallic hydroxide to form a cobalt containing precipitate which is thereafter reduced to metallic cobalt.

U.S. Pat. No. 4,218,240 relates to a method for producing cobalt metal powder by forming a solution of a cobalt hexammine compound from an acid solution and treating the solution with a metallic hydroxide to form a precipitate which is reduced to cobalt metal powder. U.S. Pat. Nos. 4,348,224 and 4,381,937 relate to improvememts in the process described in 4,218,240 which involve removal of copper and silver from the cobalt. U.S. Pat. No. 4,452,633 relates to an improvement in the process described in 4,218,240 and 4,348,224 in which the silver is recovered.

U.S. Pat. No. 4,329,169 relates to a process for producing fine particle size cobalt metal powder absent tailings by heating an aqueous solution of soluble cobalt ammine halide to decompose the halide and form a cobalt containing precipitate which is reduced to the cobalt metal powder.

U.S. Pat. No. 4,409,019 relates to a process for producing fine cobalt metal powder from pieces of relatively pure cobalt by dissolving the cobalt pieces in an aqueous solution of hydrogen iodide and iodine and forming a cobalt containing solid which is subsequently reduced to a fine cobalt metal powder.

SUMMARY OF THE INVENTION

In accordance with one aspect of this invention there is provided a process for producing cobalt metal powder. The process involves contacting a cobaltous salt with a sufficient amount of an alkaline earth halide in an aqueous solution at a sufficient temperature for a sufficient time to form a solution which is essentially cobaltous halide and a solid which consists essentially of a salt of the alkaline earth and the anion of the cobaltous salt. The cobaltous halide solution is removed from the solid and the ions in the solution are complexed with ammonia in the presence of a catalyst to form a cobaltic hexammine ion. The resulting solution is treated with an acid in the presence of halide ions to form a cobaltic hexammine halide precipitate which is removed from the resulting mother liquor and dissolved in an aqueous solution to form a relatively pure solution which is treated with a sufficient amount of a metallic hydroxide to form a cobalt containing precipitate which is reduced to cobalt metal.

DETAILED DESCRIPTION OF THE INVENTION

For a better understanding of the present invention, together with other and further objects, advantages, and capabilities thereof, reference is made to the following disclosure and appended claims in connection with the above description of some of the aspects of the invention.

The present invention is designed to convert relatively impure cobaltous salts to a cobaltous halide, and thereafter to convert the cobaltous halide to pure cobalt metal powder.

The cobaltous salt is preferably cobaltous oxalate or cobaltous sulfate.

Cobaltous oxalate is produced by methods known in the art such as by contacting cobaltous chloride with oxalic acid or ammonium oxalate.

Cobaltous sulfate is a by-product of nickel refining. Therefore, this invention is a means of conserving the cobalt contained therein.

The cobaltous salt is contacted with a sufficient amount of an alkaline earth halide in an aqueous solution at a sufficient temperature for a sufficient time to form a solution which is essentially a cobaltous halide and a solid which consists essentially of the salt of the alkaline earth and the anion of the cobaltous salt.

The alkaline earth halide is preferably calcium chloride or barium chloride and most preferably calcium chloride.

The preferred procedure is to dissolve the alkaline earth halide in water and heat to a temperature at which conversion to the cobaltous halide will take place, and then to add the cobaltous salt and agitate the resulting mixture for a sufficient time at temperature to allow the cobaltous halide to form. When cobaltous oxalate is used as the cobaltous salt, the temperature is preferably at least about 90° C. When cobaltous sulfate is used, the temperature is preferably at least about 50° C. and most preferably at least about 75° C. to increase the speed of reaction.

The amounts of alkaline earth halide and cobaltous salt can vary depending on the cobaltous salt. For example, with cobaltous sulfate, the preferred mole ratio is about 1 to 1. With cobaltous oxalate, the amounts depend on the temperature. The table below shows the effect of temperature and mole ratio of calcium chloride to cobaltous oxalate on degree of conversion to the calcium chloride.

TABLE

Temperature and Concentration vs Percent Conversion To $CoCl_2$

| Temp. °C. | Moles $CaCl_2$ Moles $CoC_2O_4$ | Starting Cobalt g | Cobalt in Precipitate g | Percent Conversion |
|---|---|---|---|---|
| 60 | 2.0/1.0 | 2.0 | 1.1 | 45 |
| 60 | 2.5/1.0 | 2.0 | 1.17 | 41.5 |
| 60 | 3.0/1.0 | 2.0 | .81 | 59.5 |
| 90 | 2.0/1.0 | 2.0 | .81 | 59.5 |
| 90 | 2.5/1.0 | 2.0 | .43 | 78.5 |
| 90 | 3.0/1.0 | 2.0 | .11 | 94.5 |
| 100 | 2.0/1.0 | 2.0 | .64 | 68 |
| 100 | 2.5/1.0 | 2.0 | .009 | 99.5 |
| 100 | 3.0/1.0 | 2.0 | .01 | 99.5 |

It can be seen that a temperature of at least about 90° C. and a mole ratio of from about 2 to about 3 of calcium chloride per mole of cobaltous oxalate is preferred to give a high conversion.

The time of contact of the alkaline earth chloride with the cobaltous salt depends on the temperature. Usually the time is from about 0.5 hours to about 2.0 hours.

The resulting cobaltous halide solution is then separated from the solid by any standard technique such as filtration.

The cobalt ions in the cobaltous halide solution are then complexed with ammonia in the presence of a catalyst to form a cobaltic hexammine ion. The resulting cobaltic hexammine ion containing solution is then treated with an acid, preferably hydrochloric acid in the presence of halide ions to form a cobaltic hexammine precipitate. The precipitate is removed from the resulting mother liquor and impurities and dissolved in an aqueous solution to form a relatively pure solution. This relatively pure solution of the cobaltic hexammine is then treated with a sufficient amount of a metallic hydroxide, which is preferably sodium hydroxide to form a cobalt containing precipitate which is reduced to cobalt metal.

The cobalt metal is typically about 99.9% pure.

Details of the process to complex the cobalt ions in the cobaltous halide solution and thereafter process the complexed cobalt to cobalt metal powder are described in U.S. Pat. No. 4,218,240. That patent is hereby incorporated by reference.

To more fully illustrate this invention, the following nonlimiting examples are presented. All parts, portions, and percentages are on a weight basis unless otherwise stated.

EXAMPLE 1

Cobaltous oxalate (about 27% cobalt) with the following impurities is used in this example: >1% on a cobalt basis of Fe, Mn, Ni, W, and Na; 0.1–0.5% on a cobalt basis Al, Cr, Mg, and Ti.

About 94.4 parts of $CaCl_2$ is added to about 200 parts of water and the mixture is heated to about 100° C. About 74.1 parts of cobaltous oxalate are then added and the resulting mixture is agitated for about 1 hour. The resulting mixture is then cooled to about 60° C. and filtered to remove the solid calcium oxalate from the cobaltous chloride solution. Analysis of the washed and dried solid shows about 0.26% cobalt remaining. Analysis of the cobaltous chloride solution shows about 80.0 gCo/l and about 66 gCa/l, which represents a conversion of cobaltous oxalate to cobaltous chloride of greater than about 99.5%. The cobaltous chloride is then converted to the cobalt metal powder according to U.S. Pat. No. 4,218,240. Analysis of the metal powder is given below in weight ppm.

| Ca | Mg | Mn | Ni | Si | Al | Cr | Fe |
|---|---|---|---|---|---|---|---|
| 135 | 38 | <3.0 | <10 | 19 | <15 | <8.0 | 26 |

The metal powder is greater than about 99.9% pure.

EXAMPLE 2

About 3.77 parts of $CaCl_2$ is dissolved in about 20 parts of deionized water. After heating to from about 60° to about 75° C., about 9.54 parts of solid $CoSO_4.7H_2O$ are added. More water is added and the mixture is agitated for about ½ hour. After filtration the resulting solution is found to contain about 34 gCo/l, about 1.9 gCa/l, and about 9.1 $gSO_4$/l. The dried calcium sulfate solids contain from about 5 to 50 ppm Co.

EXAMPLE 3

About 5.61 parts of $CaCl_2$ are dissolved in about 25 parts of deionized water. After heating to about 70° C., about 9.54 parts of solid $CoSO_4.7H_2O$ are added. The resulting mixture is agitated for about 15 minutes and filtered. The resulting solution contains about 45 gCo/l, about 15 gCa/l, and about 1.9 $gSO_4$/l. The solids contain about 50 ppm Co.

While there has been shown and described what are at present considered the preferred embodiments of the invention, it will be obvious to those skilled in the art that various changes and modifications may be made therein without departing from the scope of the invention as defined by the appended claims.

What is claimed is:

1. A process for producing pure cobalt metal powder, said process comprising:

(a) contacting a cobaltous salt with a sufficient amount of an alkaline earth halide in an aqueous solution at a sufficient temperature for a sufficient time to form a solution which is essentially cobaltous halide and a solid which consists essentially of a salt of said alkaline earth and the anion of said cobaltous salt;

(b) removing the cobaltous halide solution from the solid;

(c) complexing the cobaltous ions in the cobalt halide solution with ammonia in the presence of a catalyst to form a cobaltic hexammine ion;

(d) treating the resulting cobaltic hexammine ion containing solution with an acid in the presence of halide ions to form a cobaltic hexammine halide precipitate;

(e) removing said precipitate from the resulting mother liquor and impurities;

(f) dissolving said precipitate in an aqueous solution to form a relatively pure solution thereof;

(g) treating said relatively pure solution with a sufficient amount of a metallic hydroxide to form a cobalt containing precipitate; and (h) reducing said cobalt containing precipitate to form cobalt metal.

2. A process of claim 1 wherein said cobaltous salt is cobaltous oxalate.

3. A process of claim 2 wherein the amount of said alkaline earth halide is from about 2 to about 3 moles per mole of cobaltous oxalate and the temperature is greater than about 90° C.

4. A process of claim 1 wherein said cobaltous salt is cobaltous sulfate.

5. A process of claim 4 wherein the amount of said alkaline earth halide is at least about 1 mole per mole of cobaltous sulfate and the temperature is at least about 50° C.

6. A process of claim 1 wherein said alkaline earth halide is selected from the group consisting of calcium chloride and barium chloride.

7. A process of claim 6 wherein said alkaline earth halide is calcium chloride.

* * * * *

UNITED STATES PATENT AND TRADEMARK OFFICE

CERTIFICATE OF CORRECTION

PATENT NO. : 4,690,710

DATED : September 1, 1987

INVENTOR(S) : Richard A. Scheithauer, et al.

It is certified that error appears in the above-identified patent and that said Letters Patent is hereby corrected as shown below:

The term of this patent subsequent to June 10, 2003, has been disclaimed.

Signed and Sealed this

Sixth Day of December, 1988

*Attest:*

DONALD J. QUIGG

*Attesting Officer*

*Commissioner of Patents and Trademarks*